US009822792B2

(12) United States Patent
Guemmer

(10) Patent No.: US 9,822,792 B2
(45) Date of Patent: Nov. 21, 2017

(54) ASSEMBLY FOR A FLUID FLOW MACHINE

(71) Applicant: Rolls-Royce Deutschland Ltd & Co KG, Blankenfelde-Mahlow (DE)

(72) Inventor: Volker Guemmer, Mahlow (DE)

(73) Assignee: Rolls-Royce Deutschland Ltd & Co KG, Blankenfelde-Mahlow (DE)

( * ) Notice: Subject to any disclaimer, the term of this patent is extended or adjusted under 35 U.S.C. 154(b) by 403 days.

(21) Appl. No.: 14/290,266

(22) Filed: May 29, 2014

(65) Prior Publication Data

US 2014/0356143 A1 Dec. 4, 2014

(30) Foreign Application Priority Data

May 31, 2013 (DE) ..... 10 2013 210 167

(51) Int. Cl.
*F04D 29/52* (2006.01)
*F04D 29/16* (2006.01)
(Continued)

(52) U.S. Cl.
CPC ..... *F04D 29/161* (2013.01); *F04D 29/526* (2013.01); *F04D 29/541* (2013.01);
(Continued)

(58) Field of Classification Search
CPC .... F04D 29/526; F04D 29/681; F04D 29/685; F04D 27/0207; F04D 27/0215; F04D 27/0238
See application file for complete search history.

(56) References Cited

U.S. PATENT DOCUMENTS 3,462,071 A 8/1969 Garve
3,572,960 A 3/1971 McBride
(Continued)

FOREIGN PATENT DOCUMENTS

BE 680460 10/1966
BE 743057 2/1970
(Continued)

OTHER PUBLICATIONS

European Search Report dated Nov. 3, 2014 for counterpart European Patent Application No. 14170055.9.
(Continued)

*Primary Examiner* — Woody Lee, Jr.
*Assistant Examiner* — Behnoush Haghighian
(74) *Attorney, Agent, or Firm* — Shuttleworth & Ingersoll, PLC; Timothy J. Klima

(57) ABSTRACT

A structural assembly for a fluid-flow machine includes: a main flow path boundary and at least one row of relatively rotating blades with a gap existing between blade ends of the at least one row of blades and the main flow path boundary. At least one secondary flow duct has in the main flow path boundary one opening each at ends spaced apart in the flow direction, such that the secondary flow duct is connected to the main flow path via the two openings. The structural assembly has at least two components connected to one another, i.e. at least one support component and at least one connecting component, where the support component at least partially forms the main flow path boundary and where the connecting component forms or surrounds at least one part-section of the secondary flow duct.

23 Claims, 9 Drawing Sheets

(51) Int. Cl.
*F04D 29/54* (2006.01)
*F04D 29/68* (2006.01)
*F04D 27/02* (2006.01)

(52) U.S. Cl.
CPC ..... *F04D 29/681* (2013.01); *F04D 29/685* (2013.01); *F04D 27/0207* (2013.01); *F04D 27/0215* (2013.01); *F04D 27/0238* (2013.01)

(56) References Cited

U.S. PATENT DOCUMENTS 5,586,859 A * 12/1996 Nolcheff ..... F01D 11/08 415/173.1
5,863,178 A 1/1999 Scheinert et al.
6,585,479 B2 7/2003 Torrance
6,742,983 B2 6/2004 Schmuecker
7,967,556 B2 * 6/2011 Gummer ..... F04D 27/0215 415/144
8,043,046 B2 * 10/2011 Guemmer ..... F04D 29/681 415/115
8,152,445 B2 4/2012 Guemmer
8,262,340 B2 9/2012 Guemmer
8,382,422 B2 2/2013 Guemmer
8,683,811 B2 4/2014 Clemen et al.
2003/0035715 A1 * 2/2003 Torrance ..... F01D 11/08 415/58.5
2005/0226717 A1 10/2005 Xu
2006/0153673 A1 * 7/2006 Guemmer ..... F01D 5/145 415/115
2011/0076133 A1 * 3/2011 Agneray ..... F04D 29/681 415/115
2012/0201654 A1 * 8/2012 Bouru ..... F04D 27/0207 415/116
2013/0236300 A1 * 9/2013 Hiller ..... F04D 27/0238 415/182.1

FOREIGN PATENT DOCUMENTS

DE 1964057 7/1970
DE 69616435 1/1997
DE 19647605 5/1998
DE 10135003 10/2002
DE 10330084 3/2004
DE 102004030597 1/2006
DE 102008037154 2/2010
EP 0497574 8/1992
EP 0754864 1/1997
EP 1286022 2/2003
EP 1659293 5/2006
EP 2000649 12/2008
EP 2639411 A1 9/2013

OTHER PUBLICATIONS

German Search report dated Nov. 19, 2013 from counterpart German App No. 102013210167.8.
European Examination Report dated Jun. 7, 2017 for counterpart European Application No. 14170055.9.

* cited by examiner

REPLACEMENT SHEET
FIG 1A (Prior Art)
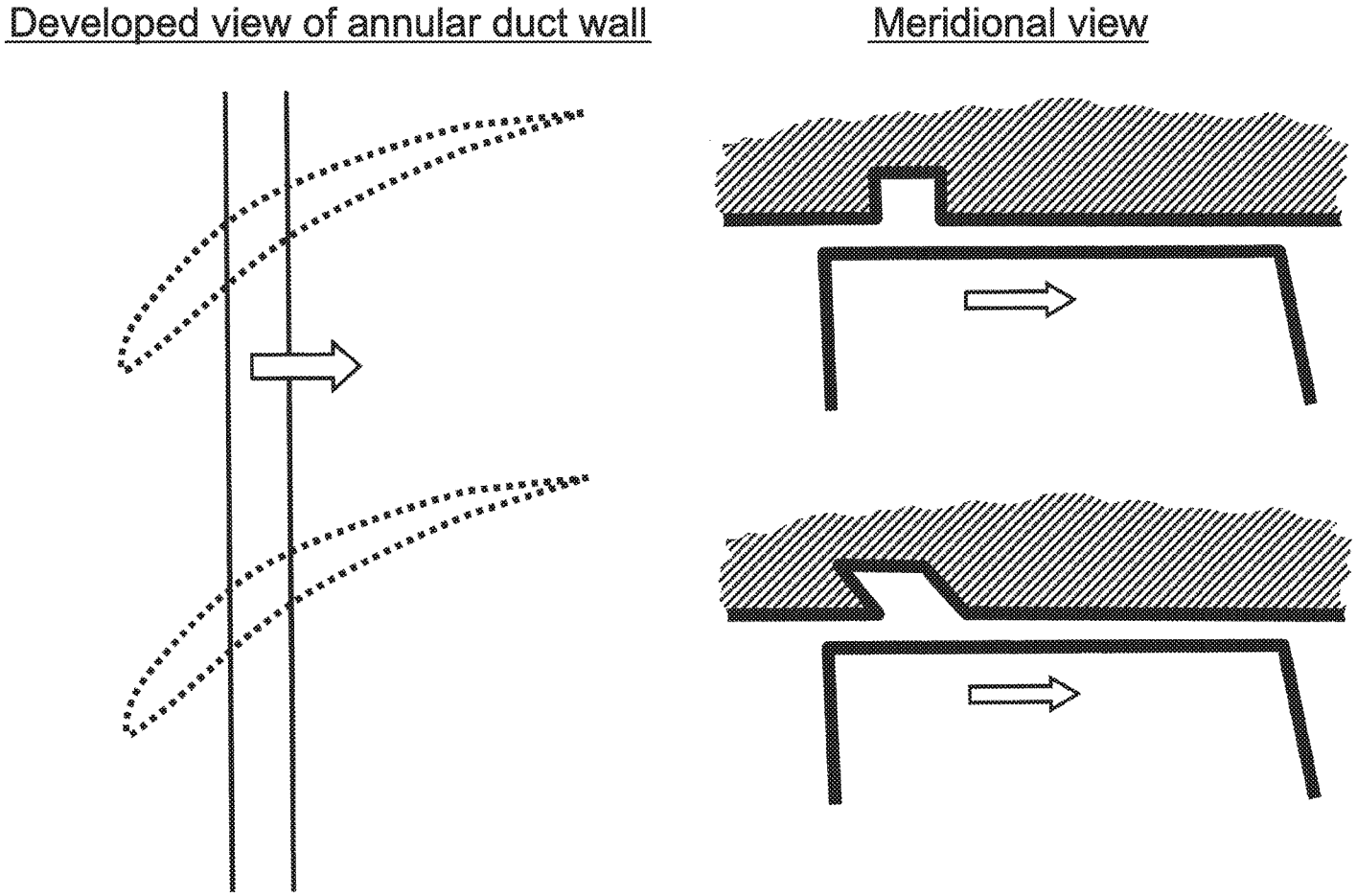

REPLACEMENT SHEET
FIG 1B (Prior Art)
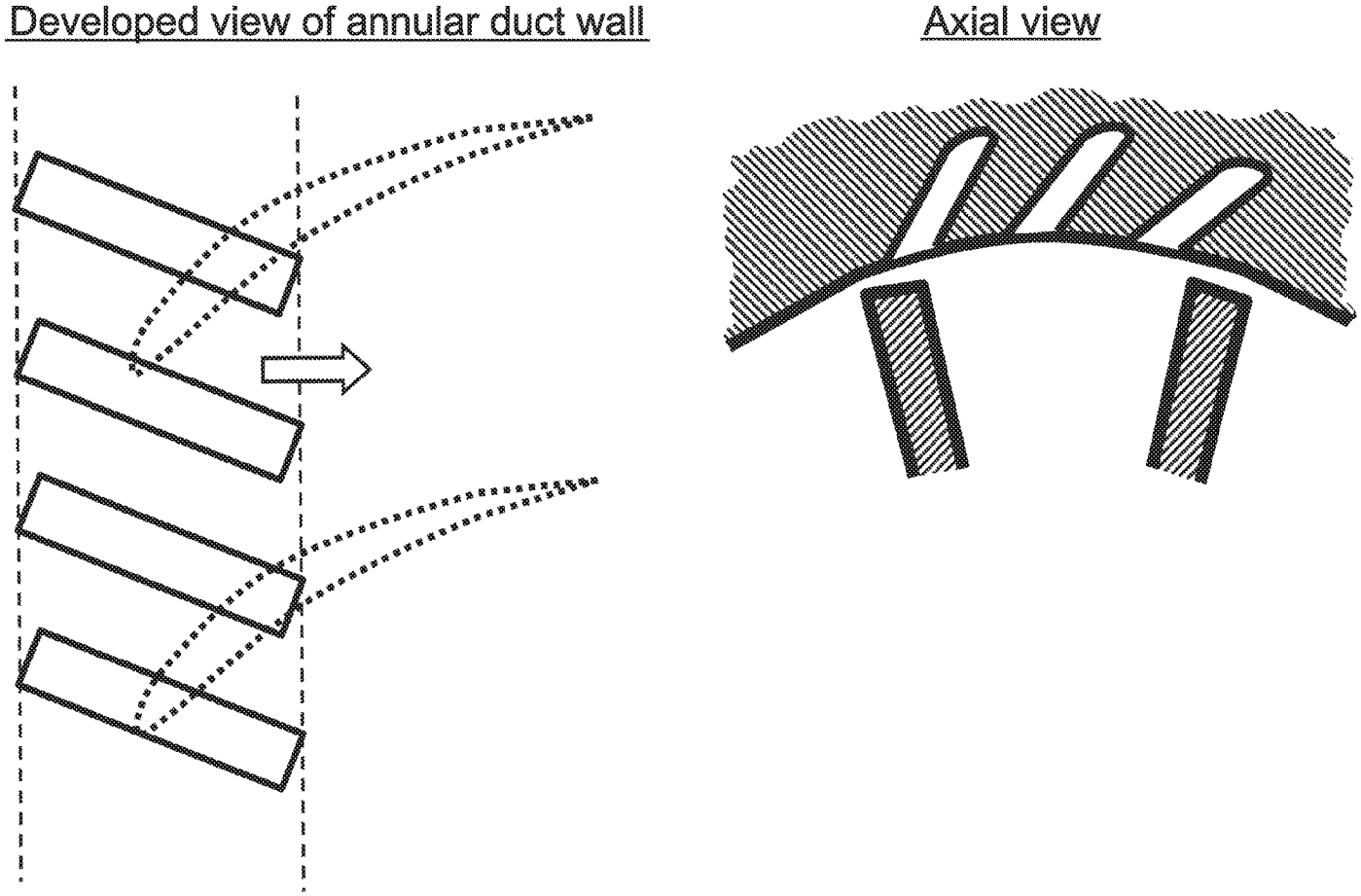

ASSEMBLY FOR A FLUID FLOW MACHINE

This application claims priority to German Patent Application 102013210167.8 filed May 31, 2013, the entirety of which is incorporated by reference herein.

This invention relates to a structural assembly for a fluid-flow machine in accordance with the generic part of patent claim 1.

The aerodynamic loadability and the efficiency of fluid-flow machines, in particular of fluid-flow machines such as blowers, compressors, pumps and fans, is limited by the growth and the separation of boundary layers in the rotor and stator blade tip area near the casing or the hub wall, respectively. On blade rows with running gap, this leads to high secondary losses and possibly to the occurrence of operational instabilities at higher loads.

A known counter-measure is to use so-called casing treatments. The simplest form of casing treatments are circumferential grooves having rectangular or parallelogram-shaped cross-sections, as disclosed for instance in EP 0 754 864 A1 and illustrated in FIG. 1*a* by way of example. Other solutions provide for rows of slots or openings in the casing, with the individual slots/openings being oriented substantially in the flow direction and having a slender form with a small extent when viewed in the circumferential direction of the machine. Solutions of this kind are disclosed for instance in DE 101 35 003 C1 and illustrated in FIG. 1*b* by way of example.

Further casing treatments include provision of a ring over the entire circumference in the area of a rotor in the casing, with stator vanes often being provided to reduce the flow swirl inside the treated casing, as for example described in the publications EP 0 497 574 A1, US 2005-0226717 A1, U.S. Pat. No. 6,585,479 B2, US 2005-0226717 A1 and DE 103 30 084 A1.

Existing concepts for casing treatments in the form of slots and/or chambers in the annular duct wall offer increased stability of the fluid-flow machine. This is however only achieved with a loss in efficiency due to the unfavourably selected arrangement or shape. Known solutions also take up a large installation space at the periphery of the annular duct of the fluid-flow machine, and due to their shape (e.g. simple parallelogram-shaped circumferential casing grooves) they are only of restricted effectiveness and are always provided in the casing in the area of a rotor blade row. Casing treatments according to the state of the art are intended for easy implementation in the casing from an accessible side with the aid of machining, usually metal-cutting.

A fluid-flow machine is known from DE 10 2008 037 154 A1, which has, in the area of the blade leading edge in a main flow path boundary, at least one secondary flow duct connecting to one another two openings arranged on the main flow path boundary. Each secondary flow duct connects one discharge opening to a supply opening provided further upstream. The provision of secondary flow ducts of this type permits effective influencing of the boundary layer in the blade tip area and hence allows an increase in the stability of a fluid-flow machine, without the need for an expensive casing treatment over the entire casing circumference in the area of a rotor. However, complex secondary flow ducts in the area of the casing or hub can only be achieved by specific design and production measures.

Based on DE 10 2008 037 154 A1, the object underlying the present invention is to provide a structural assembly that can efficiently provide secondary flow ducts, even those of complex shape, in the area of a main flow path boundary of a fluid-flow machine (i.e. in the area of the casing or hub). The intention is to provide a spatially compact and sturdy structural design.

It is a particular object to provide solution to the above problems by a structural assembly having features as described herein and a fluid-flow machine having features as described herein. Embodiments will become apparent from the present description.

It is accordingly provided in accordance with the invention that the structural assembly is formed by at least two components connected to one another, i.e. by at least one support component and at least one connecting component, where the support component at least partially forms the main flow path boundary and where the connecting component forms or surrounds at least one part-section of the secondary flow duct. This means that the connecting component forms or surrounds by itself (i.e. not together with further components) at least one part-section of the secondary flow duct. In other words, the connecting component surrounds at least one part-section of the secondary flow duct so completely that all wetted surfaces of the secondary flow duct in this part-section are associated with the connecting component in undivided manner.

The invention thus considers a section of the main flow path of a fluid-flow machine, in the area of a blade row with free end and running gap, in which a row of secondary flow ducts distributed in the circumferential direction is provided. The course of the secondary flow ducts can be spatially complex in each case. In accordance with the invention, a structural assembly is provided for structural implementation of said secondary flow ducts.

An embodiment of the invention provides that each secondary flow duct within a meridional view is split into three part-sections: a rear part-section discharging with one opening into the main flow path, a front part-section discharging with one opening into the main flow path, and a central part-section connecting the two other part-sections to one another. It can further be provided that the connecting component is connected to the support component substantially on its side facing away from the main flow path.

According to an embodiment of the invention, at least one of the openings of the secondary flow duct is formed in the support component or in an adapter connected to said support component (which is for example an adapter inserted into the support component and forming the opening and a section of the secondary flow duct adjoining it). In particular, it can be provided that the secondary flow duct is created in at least one part-section inside the support component and in at least one part-section inside the connecting component.

According to a further embodiment of the invention, at least one of the openings of the secondary flow duct is provided in the connecting component. It can be provided here that both openings of the secondary flow duct are provided in the connecting component, so that the secondary flow duct is provided completely inside the connecting component.

The support component can in design variants of the invention be designed as an annular casing of a fluid-flow machine, as a half-shell casing of a fluid-flow machine, in annular form on the hub of a fluid-flow machine, or in semi-annular form on the hub of a fluid-flow machine.

In a further embodiment, it is provided that at least one of the part-sections of the secondary flow duct discharging into the main flow path is provided directly inside the support component, for example both part-sections of the secondary flow duct discharging into the main flow path are provided directly inside the support component. In the latter case, only a central section of the secondary flow duct is provided inside the connecting component.

It can be provided that at least one of the part-sections of the secondary flow duct discharging into the main flow path is created directly inside the support component using a metal-cutting method, an electro-chemical method or a laser method.

A further variant of the invention provides that at least one of the part-sections of a secondary flow duct discharging into the main flow path is designed at least partially as a cylinder with elliptical or circular cross-section inside the support component.

For forming at least one duct part-section of the secondary flow duct, it can be provided that at least one connector and/or web is formed on that side of the support component facing away from the main flow path. It can for example be provided here that at least one secondary flow duct part-section passes through a web or connector of the support component, where it can be further provided that the at least one web or connector is formed on at least one separate adapter, said adapter being received by the support component, for example inserted into the latter. This design variant has the advantage that possibly complex structures for creating a secondary flow duct part-section do not have to be formed inside the support component itself, but can be formed in one or more corresponding adapters inserted into the support component.

A further variant of the invention provides that the connecting component surrounds a part-section of the secondary flow duct and adjoins at least one secondary flow duct part-section created directly inside the support component. A connection of the connecting component to the support component is achieved for example by a snug fit, plug-in, clamped, bolted, welded or brazed connection.

According to an embodiment of the invention, the connecting component adjoins both a first part-section directly provided in the support component and a second part-section directly provided in the support component, where the connecting component forms or surrounds a third part-section of the secondary flow duct and forms the connection between the first and second part-sections.

A further embodiment provides that the connecting component is inserted at least in the area of an end of a secondary flow duct into openings in the support component and in this way directly adjoins the main flow path. It can be provided here that all sections of the secondary flow duct are formed inside the connecting component.

It can be provided that the connecting component is designed as a ring sector and contains at least two secondary flow ducts. The connecting component is for example designed here as a half-ring or a full ring.

According to a further embodiment of the invention, the connecting component is not designed in one part, but consists of several part-components connected to one another. This permits additional flexibility to be achieved in the manufacture and assembly of the connecting component.

The present invention generally relates to structural assemblies for fluid-flow machines, such as turbines, and in particular to fluid-flow machines such as blowers, compressors, pumps and fans of the axial, semi-axial and radial type. The working medium may be gaseous or liquid. The fluid-flow machine may include one or several stages, each having a rotor and a stator. In individual cases, the stage is formed only by a rotor.

The rotor of a fluid-flow machine, in which a structural assembly in accordance with the present invention is used, includes a number of blades, which are connected to the rotating shaft of the fluid-flow machine and impart energy to the working medium. The rotor may be provided with or without shroud at the outer blade end.

The stator of a fluid-flow machine, in which a structural assembly in accordance with the present invention is used, includes a number of stationary vanes, which may have a fixed or a free vane end both on the hub and on the casing side.

The rotor drum and the blading are usually enclosed by a casing. In other cases, e.g. in the case of aircraft or ship propellers, no such casing exists.

A fluid-flow machine, in which a structural assembly in accordance with the present invention is used, may also feature a stator, a so-called inlet guide vane assembly, upstream of the first rotor. Departing from a stationary fixation, at least one stator or inlet guide vane assembly may be rotatably borne, to change the angle of attack. Variation is accomplished for example via a spindle accessible from the outside of the annular duct.

In an embodiment, a fluid-flow machine, in which a structural assembly in accordance with the present invention is used, may include at least one row of variable rotors.

In an embodiment, a fluid-flow machine, in which a structural assembly in accordance with the present invention is used, may have two counter-rotating shafts, in the event of a multi-stage design, with the direction of rotation of the rotor blade rows alternating between stages. Here, no stators exist between subsequent rotors.

In an embodiment, a fluid-flow machine, in which a structural assembly in accordance with the present invention is used, may feature a bypass configuration such that a single-flow annular duct divides into two concentric annular ducts behind a certain blade row, with each of these annular ducts housing at least one further blade row.

The fluid-flow machine, in which a structural assembly in accordance with the present invention is used, is for example a jet engine, in particular a turbofan engine. The structural assembly is for example provided in the area of a compressor of a jet engine or turbofan engine.

The present invention furthermore relates to a fluid-flow machine having a structural assembly in accordance with the present invention.

The present invention is described in the following with reference to the figures of the accompanying drawing, showing several exemplary embodiments. In the drawing, FIG. 1A shows, in two views, a casing treatment of a rotor casing in the form of annular grooves in accordance with the state of the art, FIG. 1B shows, in two views, a casing treatment of a rotor casing in the form of slots in accordance with the state of the art, FIG. 2A shows, in meridional sectional view, an exemplary embodiment of a rotor casing of a fluid-flow machine having a secondary flow duct, FIG. 2B shows, in a three-dimensional view, an exemplary embodiment of a rotor casing of a fluid-flow machine having a secondary flow duct, FIG. 3A shows a first exemplary embodiment of a structural assembly for a fluid-flow machine forming a secondary flow duct, FIG. 3B shows a second exemplary embodiment of a structural assembly for a fluid-flow machine forming a secondary flow duct, FIG. 3C shows a third exemplary embodiment of a structural assembly for a fluid-flow machine forming a secondary flow duct;

Various casing treatments of a rotor casing according to the state of the art were described at the outset on the basis of FIGS. 1A and 1B.

Figure 2A:
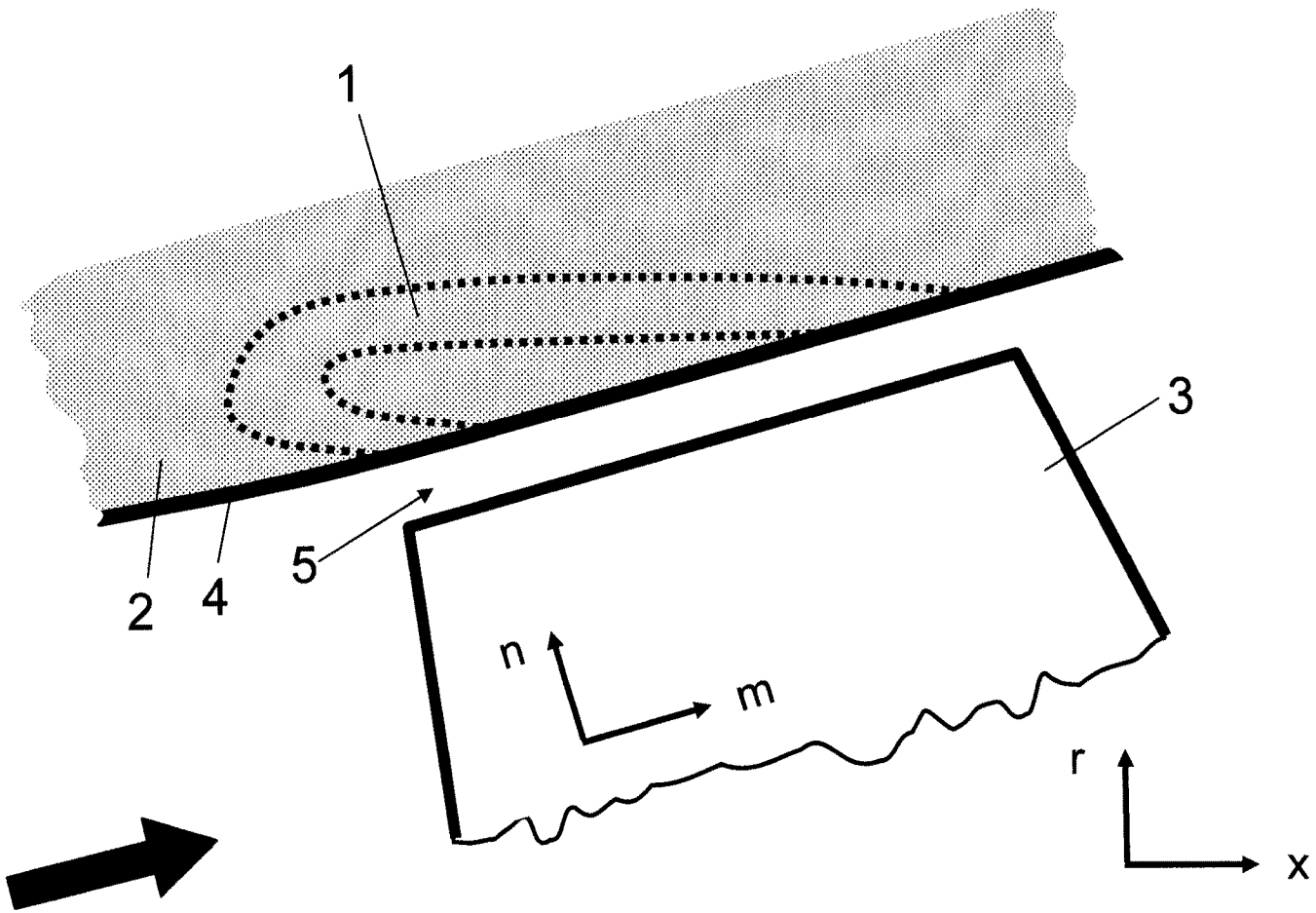

FIG. 2A shows an arrangement of a blade row 3 with free end and running gap 5 in the meridional plane established by the axial direction x and the radial direction r. The running gap 5 separates the blade tip from a component 2 associated with the main flow path on the hub or casing of the fluid-flow machine. The component 2 forms here a main flow path boundary 4 towards the main flow path.

There is a rotating relative movement between the blade tip and the component 2 associated with the main flow path. The illustration thus applies equally for the following arrangements:

1) rotating blade on stationary casing,
2) stationary blade on rotating hub,
3) stationary blade on rotating casing, and
4) rotating blade on stationary hub.

The main flow direction in the main flow path is indicated by an arrow A. Further blade rows can be located upstream and/or downstream of the blade row 3 with running gap. Inside the component 2 associated with the main flow path, a row of secondary flow ducts 1 distributed over the circumference is provided in the area of the running gap 5, said ducts having an opening at each of their ends (supply opening and discharge opening).

The openings of the secondary flow ducts are located on the main flow path boundary 4. FIG. 2A shows the outline or projection of a single secondary flow duct 1 in the meridional plane (x-r). Viewed spatially, each duct 1 has a three-dimensional and spatially winding course, shown by way of example in FIG. 2B.

Figure 2B:
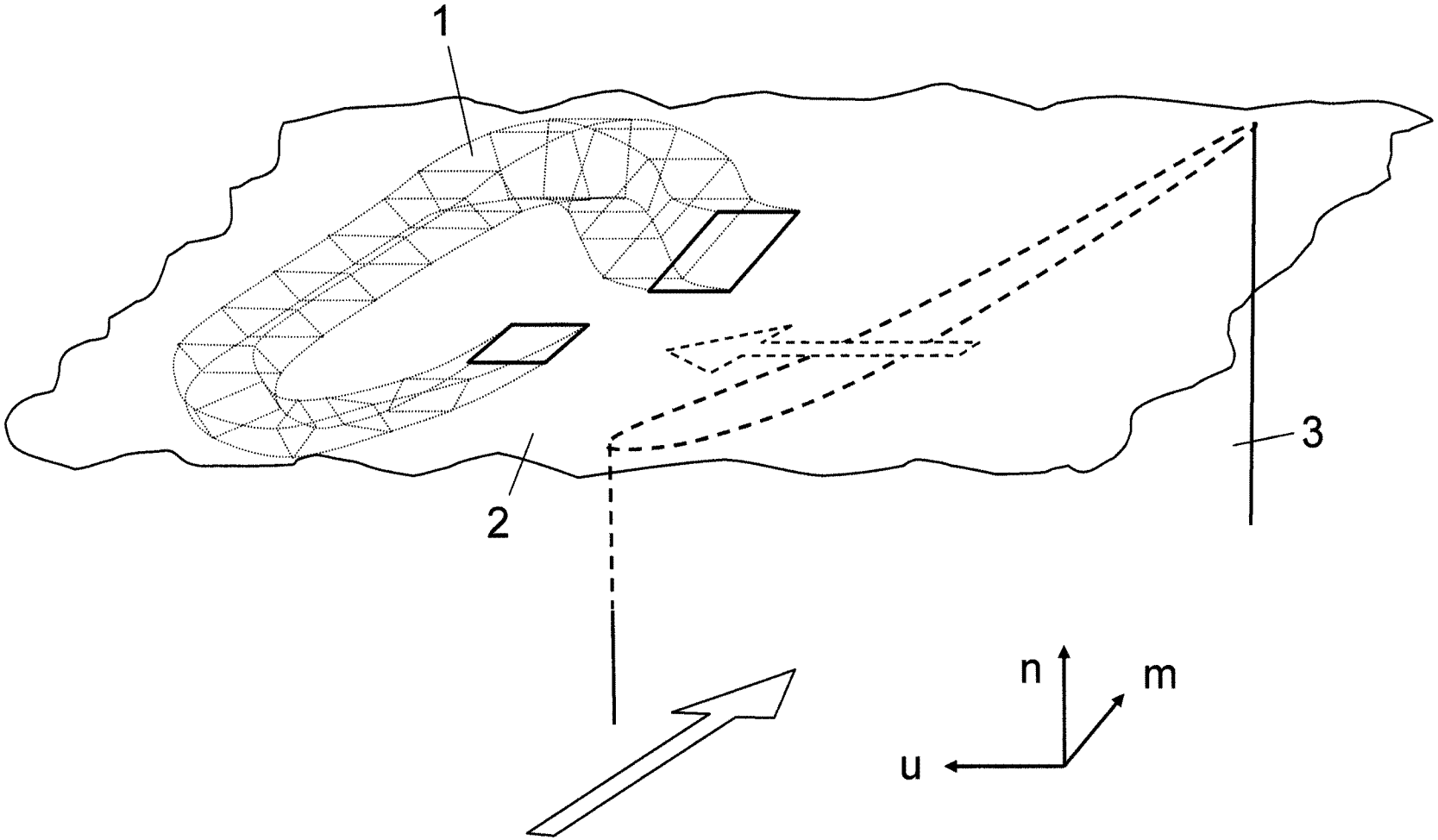

It is pointed out that the cross-sectional shape of the secondary flow ducts 1 in FIG. 2B is illustrated as rectangular only by way of example. The cross-section of the secondary flow ducts 1 in other design variants can for example be designed without corners, in particular circular or elliptical.

Figure 3A:
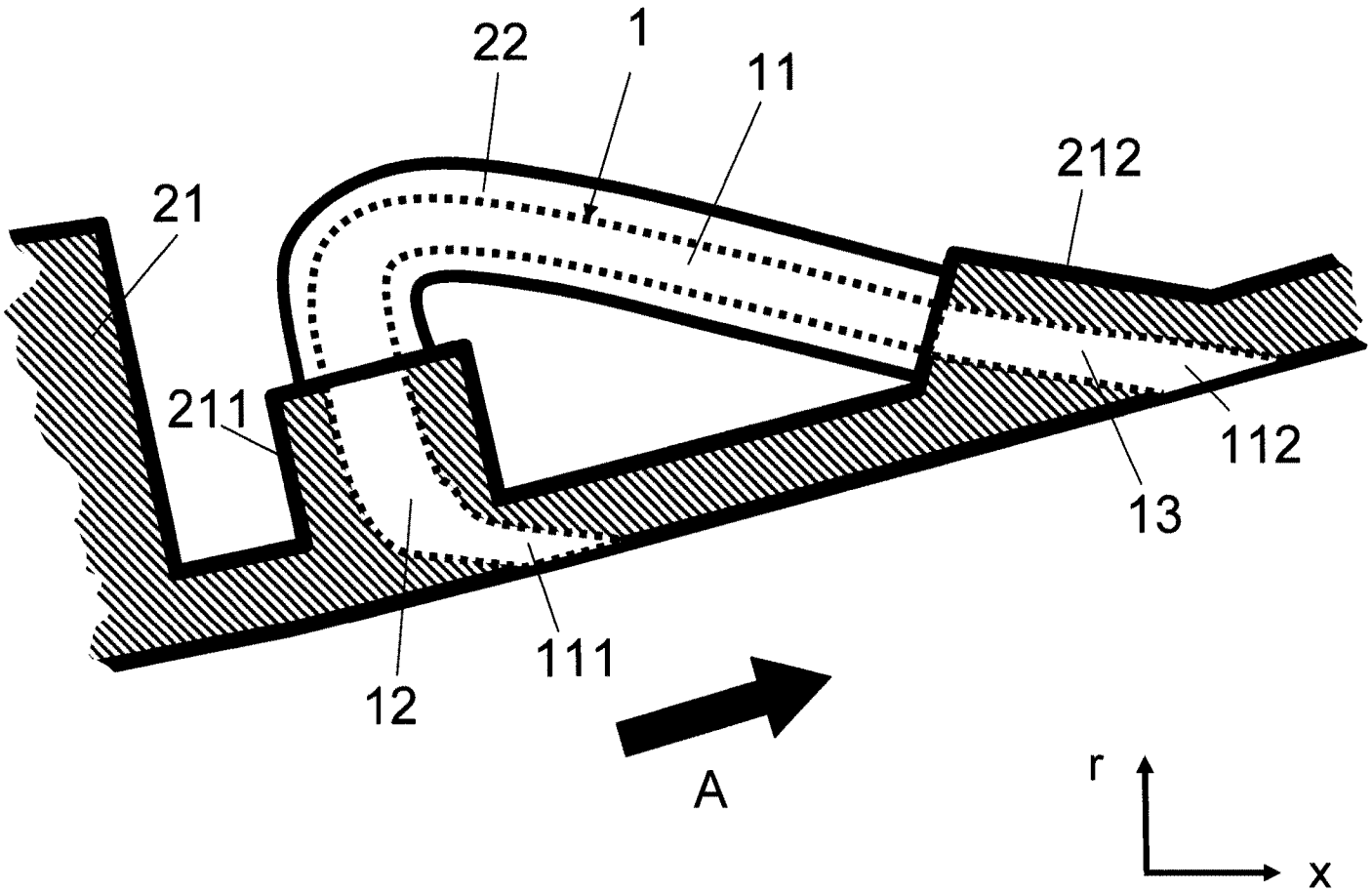

FIG. 3A shows a structural assembly in accordance with the present invention in the area of a blade row with running gap in the meridional view (x-r). The main flow direction is indicated by an arrow A. The blade row is no longer shown here for the sake of a simpler illustration.

In the structural assembly, at least one secondary flow duct 1 is provided which has two openings 111, 112 in the main flow path boundary and is connected via these openings to the main flow path. It is pointed out here that in the exemplary embodiment of FIG. 3A the secondary flow duct 1 is designed as a one-way path, having one opening through which fluid flows out of the main flow duct into the secondary flow duct and a second opening through which fluid exits the secondary flow duct. Through which of the openings 111, 112 fluid flows in, and through which of the openings 111, 112 fluid flows out, depends here on the precise positioning of the openings 111, 112 relative to the blades of the blade row 3 (cf. FIG. 2B).

Figure 4:
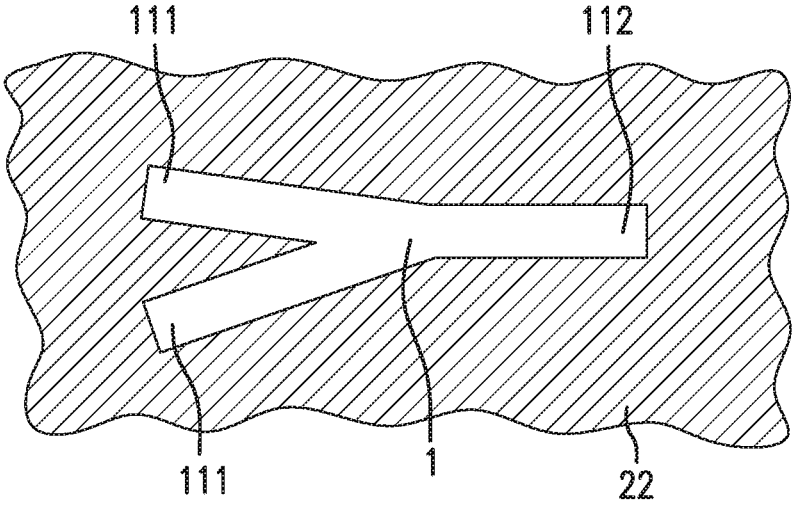
FIG. 4 shows an embodiment having a split secondary flow duct.
Figure 5:
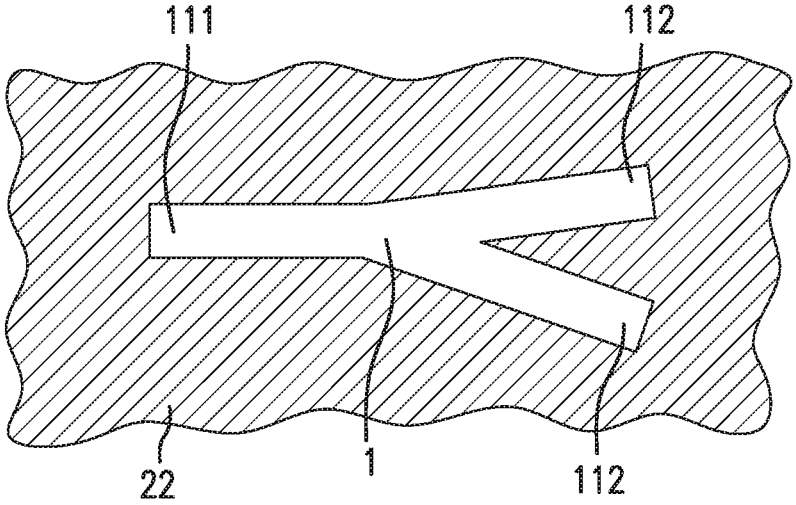
FIG. 5 shows an embodiment haying a secondary flow duct split in an opposite direction than the embodiment of FIG. 4.

In alternative embodiments, it can be provided that at least one of the secondary flow ducts is formed by an arrangement in which a single duct splits along its course into at least two part-ducts and thereby forms a type of Y-configuration. In this case, an inflow opening and several outflow openings associated with the secondary flow duct are provided. See, for instance, FIG. 4. According to a further alternative embodiment, it can be provided that at least one of the secondary flow ducts is formed by an arrangement in which at least two ducts converge into one duct, with several inflow openings and one outflow opening then being associated with the secondary flow duct. See for instance, FIG. 5. As noted in the paragraph above, which of the openings 111 and 112 are the inflow openings or the outflow openings depends on the positioning of the openings 111 and 112 relative to the blades, so the situations noted in this paragraph could also be shown by the other of FIG. 4 or FIG. 5 than noted above depending on the positioning of the openings relative to the blades.

According to FIG. 3A, the secondary flow duct 1 is achieved using two components connected to one another, a support component 21 and a connecting component 22. The support component 21 can be part of the outward casing or of the inward hub of the fluid-flow machine and forms with some of its faces the main flow path boundary. In the exemplary embodiment shown, the support component 21 represents a part of the outward casing of the fluid-flow machine. In principle, the support component 21 can in particular be a part of the fluid-flow machine design in the following areas:

- part of a single-shell or multi-shell casing of blade rows or stages with fixed blade geometry,
- part of a single-shell or multi-shell casing of blade rows or stages with variable blade geometry,
- part of rotor drums, rotor disks or blisk modules,
- part of inner shroud assemblies in the hub area of stator vanes.

In the exemplary embodiment of FIG. 3A, the support component is designed as an annular casing of a fluid-flow machine or as a half-shell casing of a fluid-flow machine. With an appropriate arrangement in the hub area, it is for example designed annular on the hub of a fluid-flow machine or semi-annular on the hub of a fluid-flow machine.

Figure 6:
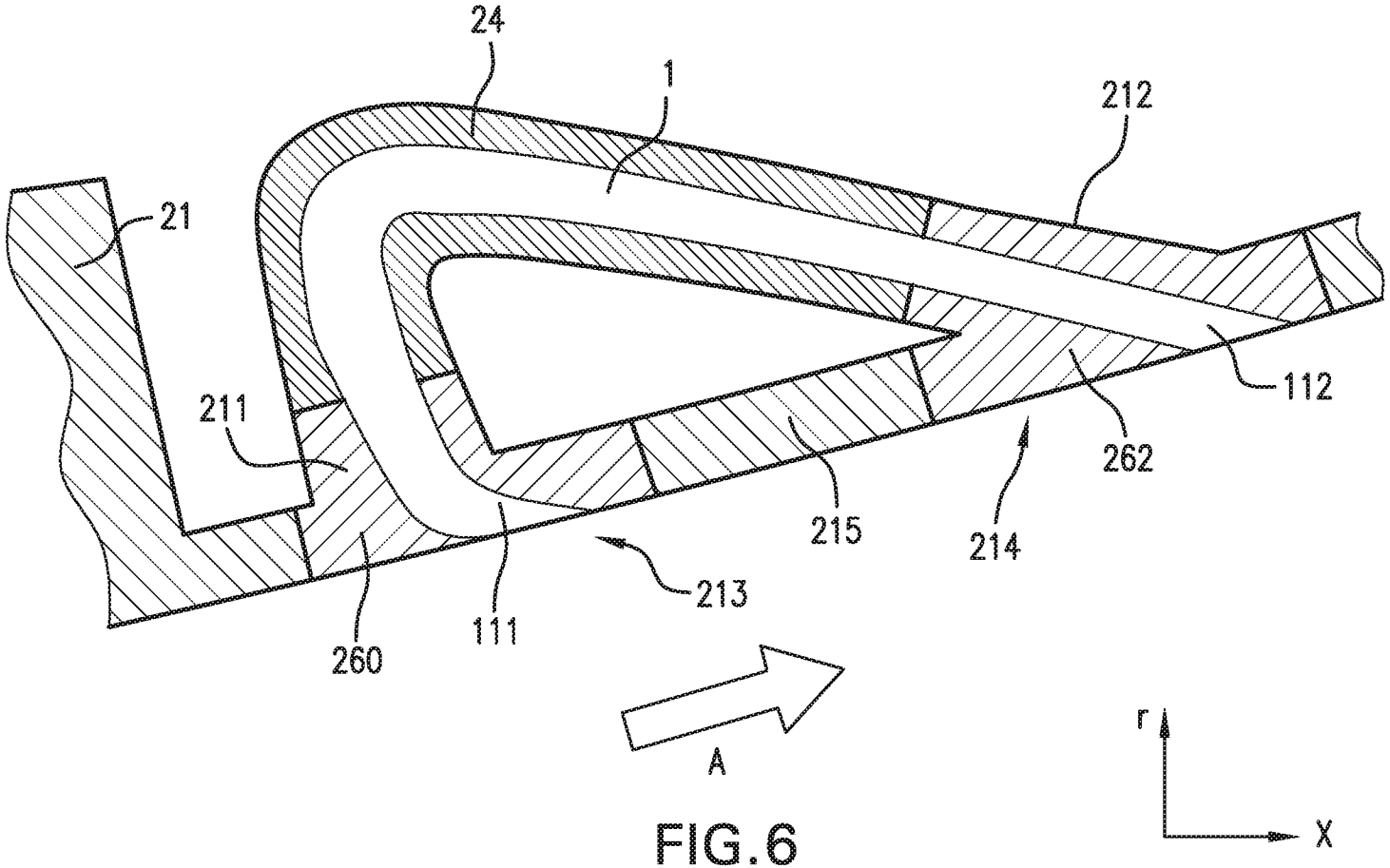
FIG. 6 shows an embodiment using adapters connected to the support component.

The support component 21 of FIG. 3A forms, on the side facing away from the main flow path, a connector 211 and, in the flow direction and at a distance thereto, a web 212 inside which part-areas 12, 13 respectively of the secondary flow duct 1 are formed and which form one of the openings 111, 112 respectively of the secondary flow duct 1 adjoining the main flow path. The web 212 can be formed on at least one separate adapter 262, the adapter 262 being recieved by the support component 21, for example inserted into the latter. See FIG. 6.

The connecting component 22 connects the two areas 211, 212 of the support component, so that in the exemplary embodiment shown the secondary flow duct 1 includes three part-sections; a rear part-section 13 provided in the web 212 of the support component 21, a central part-section 11 provided in the connecting component 22, and a front part-section 12 provided in the connector 211 of the support component 21, where the rear and front part-sections 13, 12 discharge into the main flow path via openings 112, 111 respectively.

It is provided here that the connecting component 22 forming the central part-section 11 of the secondary flow duct 1 is formed by a hose or pipe connected at its ends to a corresponding surface of the connector 212 or web 211 of the support component, for example by means of a flanged connection, not shown. Generally speaking, it can be provided that the connection of the connecting component 22 to the support component 21 is achieved by a snug fit, plug-in, clamped, bolted, welded or brazed connection.

FIG. 3A thus shows an exemplary embodiment in which a structural assembly includes a support component 21 and a connecting component 22, where the openings of the secondary flow duct 1 are provided in the support component 11 and the connecting component 22 forms or surrounds a central part-section of the secondary flow duct 1. The connecting component 22 is here arranged freely in the space as a pipe. Alternatively, at least one of the openings 111/112 of the secondary flow duct is formed in an adapter 260 connected to the support component 21 (which is for example an adapter inserted into the support component and forming the opening and a section of the secondary flow duct adjoining it). See FIG. 6.

Figure 3B:
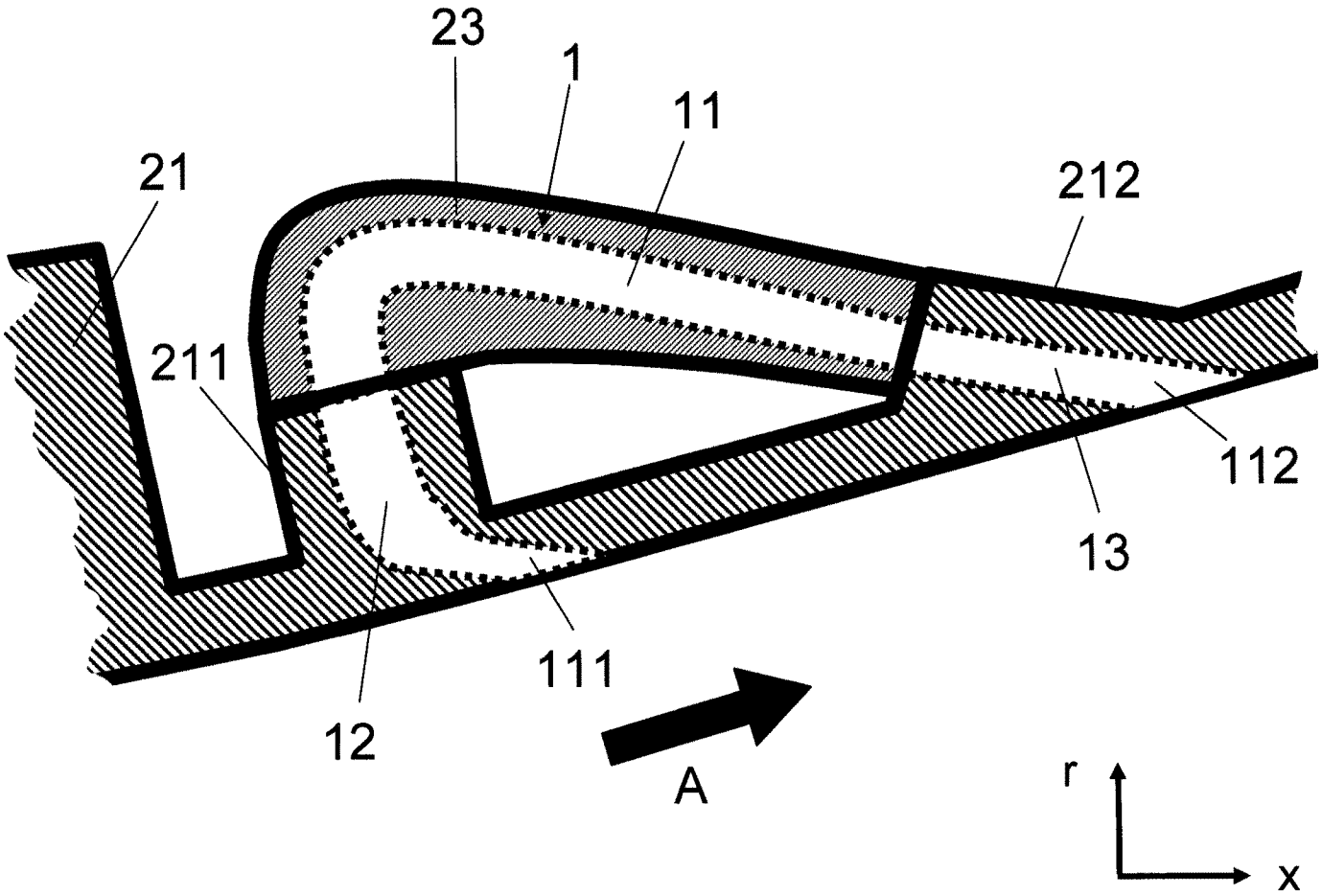

FIG. 3B shows an exemplary embodiment of a structural assembly in the area of a blade row with running gap in the meridional view (x-r), which differs from the exemplary embodiment in FIG. 3A in that a connecting component 23 is not designed as a pipe freely arranged in the space, but instead as a ring sector. The connecting component 23 is here for example designed as a half-ring or complete ring. The connecting component 23 thus represents a kind of casing shell in which one or more ducts 11 are provided which each form a central part-section of a secondary flow duct 1.

It can be provided here that due to the possible complexity of the secondary flow ducts 1, the connecting component 23 is manufactured by a casting, sintering or printing production method.

Figure 3C:
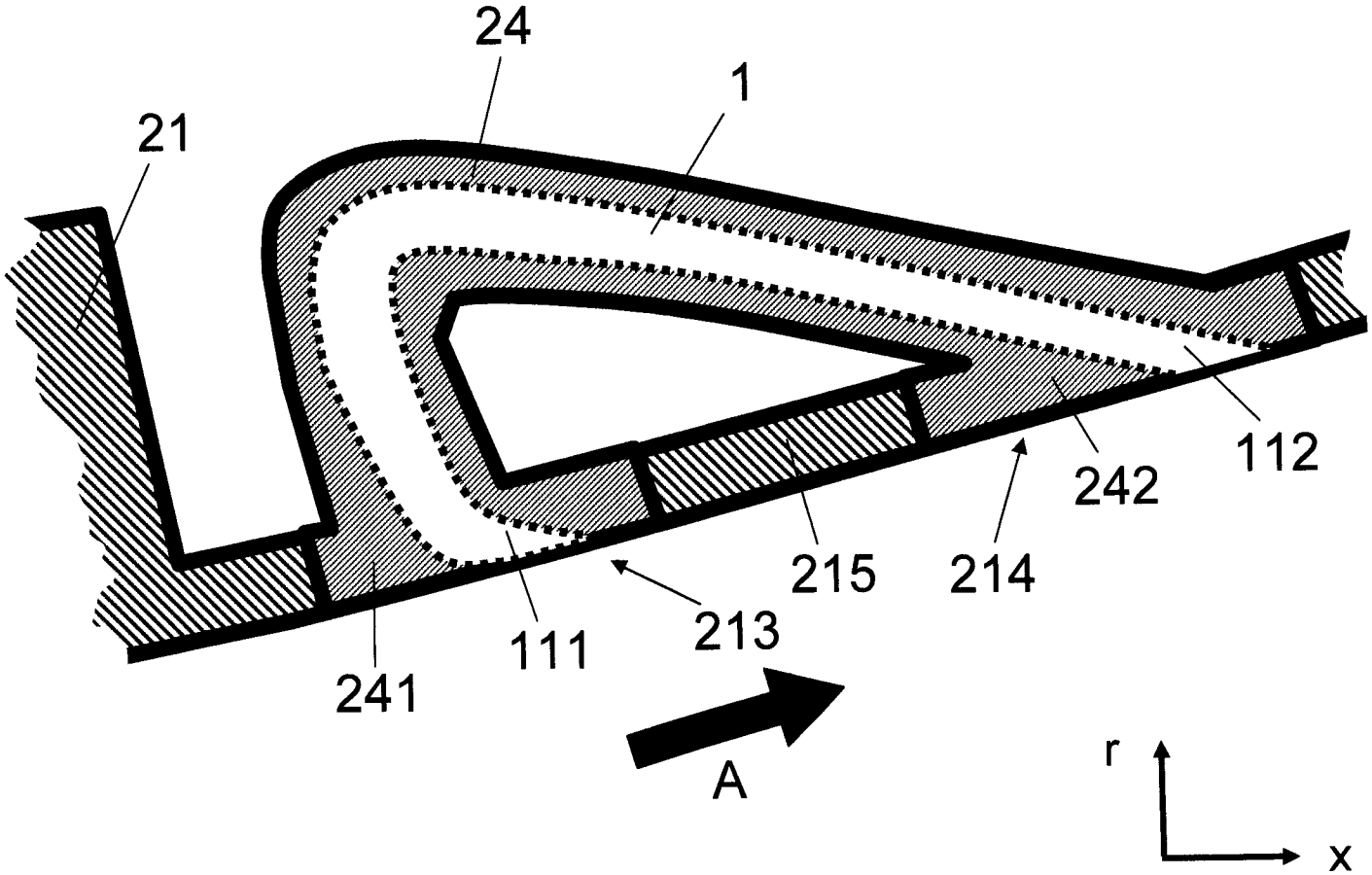

FIG. 3C shows an exemplary embodiment of a structural assembly in the area of a blade row with running gap in the meridional view (x-r), in which the secondary flow duct 1 is formed completely inside the connecting component 24. The connecting component 24 thus includes areas 241, 242 adjoining the main flow path and forming a part-section of the main flow path boundary. One of the openings 111, 112 of the secondary flow duct 1 is formed in the sections 241, 242 respectively.

The connecting component 22 is inserted into corresponding openings 213, 214 of the support component 21. A part-area 215 of the support component 21 extends between the areas 241, 242 of the connecting component 24 forming the openings 111, 112 respectively.

In further embodiments of the present invention, the design solutions described with reference to the FIGS. 3A, 3B, 3C can be combined with one another. For example, a further variant of the invention provides that the connecting component 24 of FIG. 3C consists of three part-areas, in other words the connecting component 24 is formed by three connecting part-components, where the central part-component is designed in accordance with FIG. 3A for example as a flexible hose, while the two other part-components mounted in the support component 21 can absorb structural forces.

The present invention, in its design, is not restricted to the exemplary embodiments presented above, which are only to be understood as examples.

The shape and the embodiment of the secondary flow ducts and of the components constituting them (support component and connecting component) can for example be designed in a different manner than that shown.

What is claimed is:

1. A structural assembly for a fluid-flow machine provided with:

a main flow path boundary confining a main flow path of the fluid-flow machine, where a row of blades each with one blade end is arranged in the main flow path, where a gap exists between the blade ends of the row of blades and the main flow path boundary, and where there is a rotating relative movement between the blades of the row of blade and the main flow path boundary, and a secondary flow duct, having in the main flow path boundary two openings each at ends spaced apart in a flow direction, such that the secondary flow duct is connected to the main flow path via the two openings, wherein the structural assembly includes a support component and a connecting component connected to one another, where the support component at least partially forms the main flow path boundary and where the connecting component forms or surrounds at least one part-section of the secondary flow duct, wherein the secondary flow duct within a meridional view is split into three part-sections: a rear part-section discharging with one opening into the main flow path, a front part-section discharging with one opening into the main flow path, and a central part-section connecting the two other part-sections to one another, wherein both the front and rear part-sections of the secondary flow duct discharging into the main flow path are provided directly inside the support component and both the front and rear part-sections of the secondary flow duct discharging into the main flow path are associated with the same row of blades;

wherein locally on the circumference at least one connector is formed on that side of the support component facing away from the main flow path for the provision or passage of at least one of the secondary flow duct part-sections.

2. The structural assembly in accordance with claim 1, wherein the connecting component is connected to the support component substantially on its side facing away from the main flow path.

3. The structural assembly in accordance with claim 1, wherein at least one of the openings of the secondary flow duct is formed in the support component or in an adapter inserted into the support component.

4. The structural assembly in accordance with claim 3, wherein the secondary flow duct is created in at least one part-section inside the support component and in at least one part-section inside the connecting component.

5. The structural assembly in accordance with claim 1, wherein at least one of the openings of the secondary flow duct is provided in the connecting component.

6. The structural assembly in accordance with claim 5, wherein the secondary flow duct is provided completely inside the connecting component.

7. The structural assembly in accordance with claim 1, wherein the support component is designed as an annular casing of a fluid-flow machine, as a half-shell casing of a fluid-flow machine, in annular form on the hub of a fluid-flow machine, or in semi-annular form on the hub of a fluid-flow machine.

8. The structural assembly in accordance with claim 1, wherein the secondary flow duct is designed as a one-way duct, having one opening through which fluid flows into the secondary flow duct and a second opening through which fluid exits the secondary flow duct.

9. The structural assembly in accordance with claim 1, wherein at least one secondary flow duct is formed by an arrangement in which a single duct splits along its course into at least two ducts and thereby forms a type of Y-configuration, with an inflow opening and a plurality of outflow openings being associated with a secondary flow duct.

10. The structural assembly in accordance with claim 1, wherein at least one secondary flow duct is formed by an arrangement in which at least two ducts converge into one duct, with a plurality of inflow openings and one outflow opening being associated with a secondary flow duct.

11. The structural assembly in accordance with claim 1, wherein at least one of the part-sections of the secondary flow duct discharging into the main flow path is provided directly inside the support component.

12. The structural assembly in accordance with claim 1, wherein at least one of the part-sections of the secondary flow duct discharging into the main flow path is created directly inside the support component using a metal-cutting method, an electro-chemical method or a laser method.

13. The structural assembly in accordance with claim 1, wherein at least one of the part-sections of a secondary flow duct discharging into the main flow path is designed at least partially as a cylinder with elliptical or circular cross-section inside the support component.

14. The structural assembly in accordance with claim 1, wherein at least one web extending continuously along at least part of the circumference is formed on that side of the support component facing away from the main flow path for the provision or passage of at least one of the secondary flow duct part-sections.

15. The structural assembly in accordance with claim 14, wherein the at least one web or the at least one connector is formed on at least one separate adapter, said adapter being received by the support component.

16. The structural assembly in accordance with claim 1, wherein at least one of the secondary flow duct part-sections passes through a web or a connector of the support component.

17. The structural assembly in accordance with claim 1, wherein the connecting component surrounds a part-section of the secondary flow duct and adjoins at least one secondary flow duct part-section created directly inside the support component.

18. The structural assembly in accordance with claim 1, wherein the connecting component adjoins both a first part-section directly provided in the support component and a second part-section directly provided in the support component, where the connecting component forms or surrounds a third part-section of the secondary flow duct and forms the connection between the first and second part-sections.

19. The structural assembly in accordance with claim 1, wherein the connecting component is inserted at least in the area of an end of a secondary flow duct into openings in the support component and in this way directly adjoins the main flow path.

20. The structural assembly in accordance with claim 1, wherein the connecting component contains only one secondary flow duct and is arranged at least partially as a tube or a hose freely in a space outside the support component.

21. The structural assembly in accordance with claim 1, wherein a connection of the connecting component to the support component is achieved by a snug fit, plug-in, clamped, bolted, welded or brazed connection.

22. The structural assembly in accordance with claim 1, wherein the connecting component includes a plurality of part-components connected to one another.

23. A fluid-flow machine having a structural assembly in accordance with claim 1.

* * * * *